US006209148B1

(12) United States Patent
Hoffman et al.

(10) Patent No.: US 6,209,148 B1
(45) Date of Patent: Apr. 3, 2001

(54) FLOATING WATER MASSAGE DEVICE

(76) Inventors: Mark R. Hoffman, 12314 Brady Manor Way; Royce Wettstein, 1249 Journey's End La., both of Jacksonville, FL (US) 32223

( * ) Notice: Subject to any disclaimer, the term of this patent is extended or adjusted under 35 U.S.C. 154(b) by 0 days.

(21) Appl. No.: 09/376,637

(22) Filed: Aug. 18, 1999

Related U.S. Application Data

(60) Provisional application No. 60/097,157, filed on Aug. 19, 1998.

(51) Int. Cl.[7] ..... E04H 4/00

(52) U.S. Cl. ..... 4/496; 4/487; 4/489; 4/492; 441/130

(58) Field of Search ..... 4/487–489, 492, 4/491, 493, 496, 499, 541.1, 541.3–541.6, 559, 567–569; 441/130

(56) References Cited

U.S. PATENT DOCUMENTS 3,636,944 1/1972 Bryant .
4,152,791 * 5/1979 Rose ..... 4/487
4,468,822 9/1984 McKay .
4,986,781 1/1991 Smith .
5,307,529 * 5/1994 Wang ..... 4/585
5,704,079 * 1/1998 Desnoyers ..... 4/541.6

* cited by examiner

*Primary Examiner*—Gregory L. Huson
*Assistant Examiner*—Tuan Nguyen
(74) *Attorney, Agent, or Firm*—Thomas C. Saitta

(57) ABSTRACT

A buoyant water massage device for use in a swimming pool, the device having a body support structure capable of supporting a person's body at the surface of the water, where the body support structure has an opening through which pressurized fluid streams are directed against the back of the user reclining on the device by a fluid dispersal structure. The fluid dispersal structure is connected to a pressurized water source and an air entrainment apparatus and the fluid dispersal structure is disposed a distance below the body support structure such that the fluid dispersal structure does not contact the user's body. Preferably the fluid dispersal structure is adjustable longitudinally relative to the body support structure.

13 Claims, 3 Drawing Sheets

FLOATING WATER MASSAGE DEVICE

This application claims the benefit of Provisional No. 60/097,157 filed Aug. 19, 1998.

BACKGROUND OF THE INVENTION

This invention relates generally to the field of floating devices capable of supporting a person at the surface of water in a pool, such as a buoyant pad, chair or cylindrical float, and more particularly to such devices in combination with means to direct pressurized streams of fluid, such as a water or water and air mixture, against the body of the person supported by the device, where the means to direct the pressurized fluid streams is separated a short distance from the body and is adjustable relative to the body of the user.

The therapeutic and relaxation effects of subjecting pressurized streams of water or water/air mixtures against a person's body are well known, and tub or small pool structures commonly referred to as personal spas, such as sold under the brand name JACUZZI, are well known. Such structures typically provide molded seating regions to support one or more users and a plurality of nozzles directed at differing locations within the structure to deliver pressurized, aerated water into the body of water in the spa and against the body of the user. The structures are typically provided as self-contained, stand-alone units or are formed as an adjunct structure to a larger swimming pool structure. These spa structures are relatively expensive and therefore many swimming pool owners cannot enjoy the benefits of a personal spa since they opt not to expend the additional funds. Several portable or individualized devices have been developed which provide the spa effect to an individual floating in a swimming pool in a relatively inexpensive manner. For example, Bryant in U.S. Pat. No. 3,636,944 provides a buoyant chair having nozzles directed toward the person occupying the chair, the nozzles releasing streams of water and air mixed together. The plumbing for the chair is connected to a pool water heater and a booster pump is required to provide the pressure to force the heated water from the nozzles. McKay in U.S. Pat. No. 4,468,822 teaches a floating lounge chair frame which in one embodiment directly supports a standard pool lounge chair or in another embodiment has webbing or other supporting means incorporated directly therein to support the user, the frame of the lounge chair being apertured to provide pressurized water streams. Smith in U.S. Pat. No. 4,986,781 shows a floating lounge pad, the pad being formed of a buoyant material and containing a hollow interior passageway with apertures on the upper support surface of the pad through which pressurized fluid is emitted directly against the body of the user.

These known devices all suffer from the drawback that either the user's body is directly supported by webbing or other means which interfere with, diffuse or completely block the flow of the pressurized fluid stream or that the user's body is in direct contact with the apertures or nozzles in the structure providing the pressurized fluid. In either event the therapeutic and relaxation effects of the pressurized stream are greatly diminished. In all the known devices, the pressurized fluid delivery means is fixed relative to the body support component of the device, such that the user cannot adjust the location of the apertures or nozzles for maximum benefit or enjoyment. To obviate these problems, the invention at hand provides a buoyant body support structure which supports the user in the water which in one embodiment minimizes the total contact area between the user's body and the support structure, or which in another embodiment having a greater area of contact for supporting the user provides for a region of non-contact in the area where the pressurized fluid streams are directed. The invention provides a fluid distribution structure for directing plural streams of pressurized water or a water/air mixture against the user's body which is distinct and separated a short distance from the support structure, such that there is no direct contact between the user's body and the fluid distribution structure. The invention further provides a structure where the fluid distribution structure is adjustable relative to the body support structure so that the pressurized streams can be directed to different areas of the user's body.

SUMMARY OF THE INVENTION

The invention comprises a floating or buoyant device capable of supporting a person's body at or near the water surface of a swimming pool, the device providing a plurality of steady or pulsating streams of pressurized fluid, such as water or a water and air mixture, against the person's body in a massaging manner for relaxation or therapeutic purposes. The body support structure of the device supports the user's body in a generally reclined or horizontal position with the head situated above the surface of the water. In one embodiment, the body support structure has a first buoyant member for supporting the neck and head of the user and a second buoyant member for supporting the lower legs and feet of the user. The first and second buoyant members are connected to each other by one or more connecting members, which may be relatively rigid or non-rigid, such that the two buoyant members are maintained at a separation distance necessary to properly support the user so that the user's head remains above water. Preferably the buoyant members provide for a relatively small contact area against the user's body, with contact by the first buoyant member being limited to the head and neck area and contact by the second buoyant member being limited to the feet, ankle and lower leg area or the back of the knees. A separate fluid dispersal means is suspended between the first and second buoyant members at a distance below the first and second buoyant members such that the fluid dispersal means itself does not contact the user's body. The fluid dispersal structure comprises a plurality of water nozzles, jets or apertures which are directed upward toward the area occupied by the user's body. The fluid dispersal structure is connected by a hose or other conduit to a source of pressurized water, preferably the pressurized water source of a pool cleaning apparatus or to the outlets of the pool filtering and circulation system. Preferably, a means to supply air and to mix the air into the water stream is also provided, with the preferred supply source means being a tube open to the atmosphere which connects to the water delivery conduit through a venturi device such that air is pulled through the tube and mixed with the water by the flow of the water. The fluid dispersal structure is adjustable relative to the first and second buoyant members such that the pressurized streams of fluid may be directed at different areas of the user's body as desired.

In a second embodiment, the body support structure is generally composed of a floating pad material made of a closed cell foam which is configured in the shape of a lounge chair having a preformed V-shaped area to support the user's torso and upper legs such that most of the user's body is supported by the floating pad in a generally reclined position, with the pad preferably having arm supports disposed above the main pad member and a lower leg support portion. An opening is provided in the back support region through which the pressurized fluid stream is directed. The fluid dispersal means is connected to the source of pressurized water and is mounted onto the underside of or within the support structure in a manner such that the nozzles or apertures do not contact the body of the user. The fluid dispersal means is adjustable in the longitudinal direction so that the streams can be aimed at variable locations. Preferably a control valve is provided such that the user can vary the pressure of the fluid stream.

DETAILED DESCRIPTION OF THE INVENTION

With reference to the drawings, the invention will now be described in detail with regard for the best mode and the preferred embodiment. A first major embodiment is directed toward the device constructed with separate floating body support members and the second major embodiment is directed toward the device where the floating body support member is configured as a pad or lounge chair.

Figure 2:
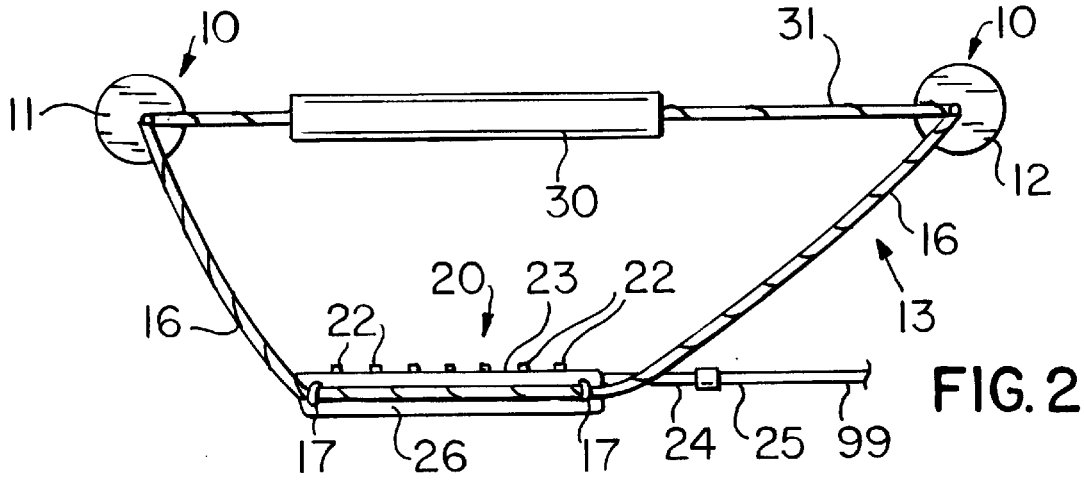
FIG. 2 is a side view of the first embodiment of the invention, but showing non-rigid connecting members joining the first and second buoyant members.
Figure 1:
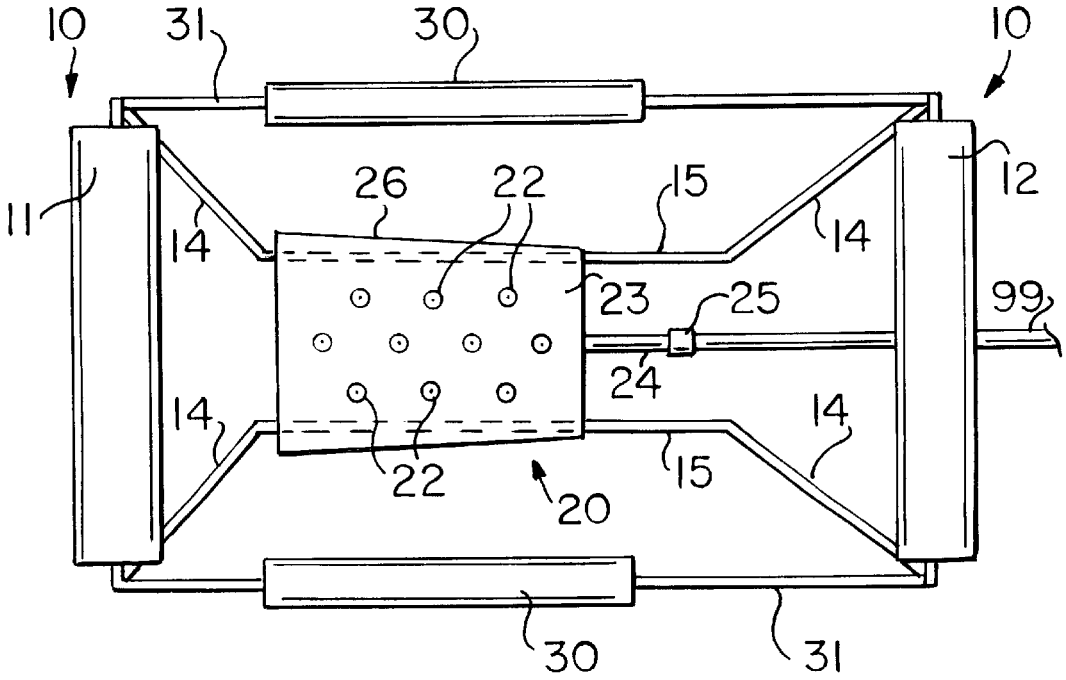
FIG. 1 is a top view of a first embodiment of the invention.

The invention is a floating water massage device, and as shown in FIGS. 1 and 2 comprises in general floating body support means 10 and fluid dispersal means 20. The body support structure 10 has a first buoyant member 11 and a second buoyant member 12, which are joined to each other by connecting means 13. The buoyant members 11 and 12 may be composed of any suitable material which floats in water and is sufficiently buoyant to support the weight of a person such that at least the person's head remains above water. For example, the buoyant members 11 and 12 may be composed of solid or hollow plastic, wood, relatively rigid or flexible polymer foam, hollow metal, inflatable bladders, etc., but are preferably formed of a soft, closed cell, polymer foam material having a vinyl coating, such as for example the material sold under the brand name ENSOLITE. As shown in the drawings, the buoyant members 11 and 12 may be formed as cylindrical members which are joined by connecting means 13 in a parallel manner. Alternatively, the buoyant members 11 and 12 may be shaped, curved or contoured to better conform to the user's body, such as by providing recesses in the surfaces of the members 11 and 12 specifically designed to receive the user's neck or legs. The connecting means 13 may be composed of relatively rigid depending frame members 14 and relatively horizontal rail members 15, such as a frame composed of polymer tubing or the like, as shown in FIG. 1, but may also be formed as a non-rigid member 16 such as a rope, cord or flexible tubing, as shown in FIG. 2 where the non-rigid member 16 is joined to the fluid dispersal means 20 by fasteners 17, such as spaced eyelets. With non-rigid frame members 16 the buoyant members 11 and 12 are prevented from separating too far, but the distance between them will automatically adjust or can be altered in relation to the size of the user.

Figure 7:
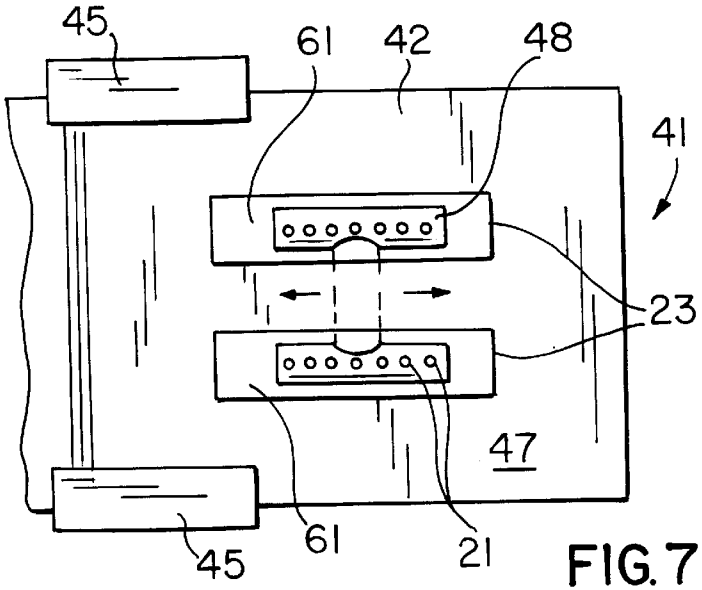
FIG. 7 is a partial top view showing an alternative configuration for the opening in the float pad and an alternative configuration for the fluid dispersal means.

Suspended between the first and second buoyant members 11 and 12 and joined to the connecting means 13 as shown in the drawings is fluid dispersal means 20. Fluid dispersal means 20 contains a plurality of apertures 21 located in an upper surface 23, the apertures 21 containing individual nozzles 22 to direct a stream of water or a water/air mixture upward from the surface 23, or the apertures 21 themselves may be sufficiently sized to act in the same manner as individual nozzles 22. The fluid dispersal means 20 preferably comprises a single hollow body chamber member 26 as shown, or it may be constructed of a plurality of interconnected tubes which form a manifold 48, an example of which is shown in FIG. 7. The fluid dispersal means 20 is provided with a water inlet 24 for passage of water into the hollow body 26, with a conduit connection means 25 for joining the water dispersal means 20 to a conduit 99 connected to a pressurized source of water, such as a water hose, the pool filter circulation system or the water source conduit for an automated pool cleaner apparatus. Preferably the conduit connection means 25 allows the conduit to be quickly removed and reattached when desired, and such connectors are well known in the industry. The chamber 26 or manifold 48 is a pressurized reservoir, such that pressurized fluid streams are emitted through and significant distance from the apertures 21 or nozzles 22. It is preferred that means also be provided for supplying air into the pressurized water stream, as the water/air mixture results in improved massage and therapeutic effects, and the mechanism for accomplishing this is explained in detail below with regard to the second embodiment.

The fluid dispersal means 20 is most preferably joined to the connecting means 13 between the buoyant members 11 and 12 so that it is relatively adjustable between the two. With this construction the fluid dispersal means 20 can be moved toward the first buoyant member 11 or toward the second buoyant member 12 to properly position the apertures 21 relative to the desires of the user by sliding the chamber 26 along rails 15 or non-rigid members 16. As shown in FIG. 1, the rail members 15 of the connecting means 13 may be disposed within longitudinal channels formed within the chamber 26. Other alternative means for attaching the water dispersal means 20 to the rails 15 or non-rigid members 16, such as through external fasteners or the like, could also be utilized.

In addition to the structure set forth above, a pair of lateral buoyant members 30 may be joined by surface connecting means 31 to the first and second buoyant members 11 and 12 to provide floatation support for the user's arms. The lateral buoyant members 30 may be constructed in any suitable manner, similar to the buoyant members 11 and 12, and the surface connecting means 31 may be relatively rigid or non-rigid. The lateral buoyant members 30 may also be contoured for comfort or efficiency.

Figure 3:
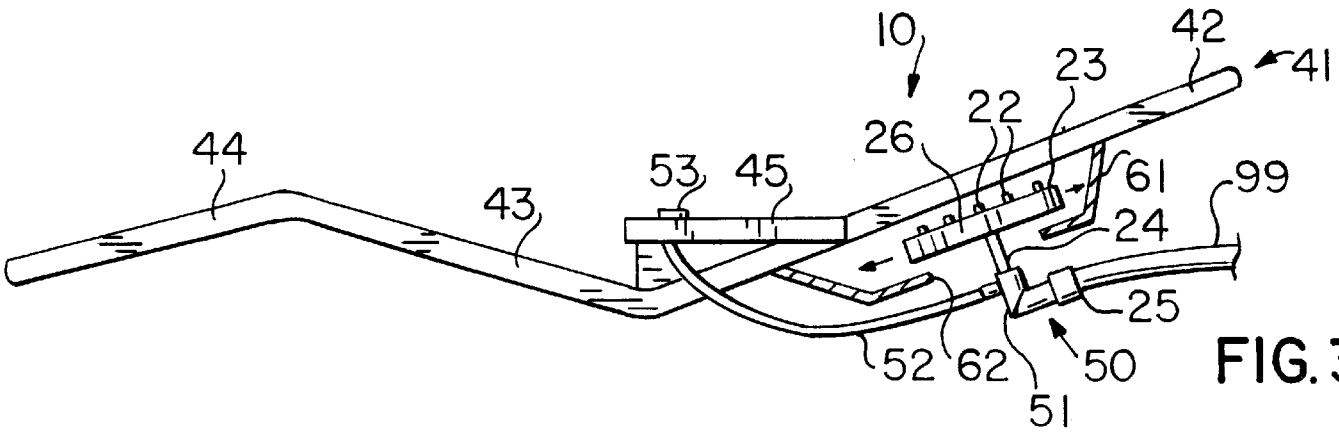
FIG. 3 is a side view of a second embodiment of the invention, where the body support means is a floating pad configured in the general shape of a lounge chair, where the fluid dispersal means is enclosed within a housing.
Figure 4:
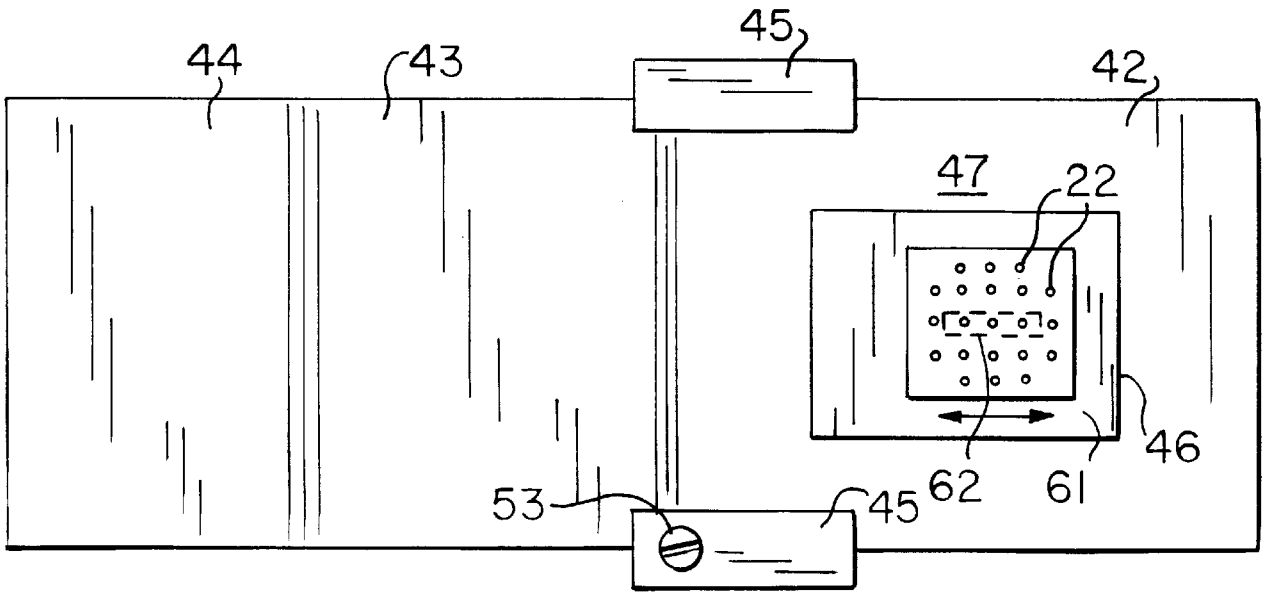
FIG. 4 is a top view of the second embodiment of the invention.
Figure 5:
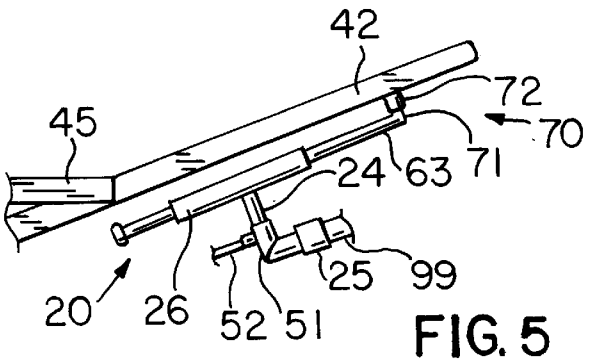
FIG. 5 is a partial side view of the second embodiment showing the fluid dispersal means mounted on rail members.
Figure 6:
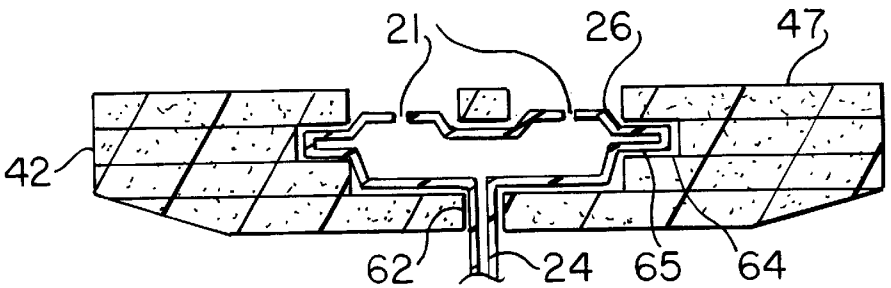
FIG. 6 is a transverse cross-sectional view of the floating chair showing the fluid dispersal means internally mounted within multiple foam layers.

An alternative embodiment of the invention is shown in FIGS. 3 through 7, wherein the body support means 10 is constructed as a floating pad or chair 41, preferably configured similar to a lounge chair with a back supporting region 42, an upper leg supporting region 43, a lower leg supporting region 44, and arm supports 45. The overall perimeter of the chair 41 is generally rectangular, with the back supporting region 42 joined to the upper leg supporting region 43 in a V-shaped or concave manner, and with the lower leg supporting region 44 joined to the upper leg supporting region 43 in an inverted V-shaped or convex manner. The chair 41 is preferably composed of a relatively soft, flexible, closed cell polymer foam encased in a vinyl coating, although other materials with similar buoyancy and comfort properties may be utilized, such as inflated bladders, hollow plastic members or the like. A relatively large opening 46 is located in the back supporting region to provide unobstructed passage for the pressurized fluid streams to reach the user's body. Opening 46 may be configured in a generally oval or rectangular shape, as shown in FIG. 4, or may be configured in an H-shape or as a pair of slots, as shown in FIGS. 6 and 7, where central longitudinal support is desired for the user. The opening 46 preferably extends over a relatively large portion of the back supporting region 42 so as to correspond generally to the area from the shoulder region to the lower back region of the user. The chair 41 may be formed from a single layer of buoyant material or from multiple layers bonded together to form regions of increased thickness, as shown in FIG. 6.

The fluid dispersal means 20 is affixed to the chair 41 such that the upper surface 23 of the main chamber 26 is disposed a short distance away from and beneath upper surface 47 of the back supporting region 42. The fluid dispersal means 20 as shown in FIGS. 3 through 6 comprises a hollow main chamber 26 with a plural number of apertures 21 disposed in the chamber upper surface 23, whereby pressurized fluid streams are emitted upwardly from the chamber 26 and through the opening 46 in the chair 41. Nozzles 22 may be provided in the apertures 21 to better control the fluid stream. The nozzles may be individually adjustable as to direction or strength. In an alternative construction, the fluid dispersal means 20 may be constructed as a combination of tubing, such as shown in FIG. 7 where the fluid dispersal means 20 comprises three tubes joined to form an H-shaped manifold 48.

A water inlet 24 is provided for delivery of pressurized water into the chamber 26 or manifold 48, which communicates with conduit connection means 25 for joining the fluid dispersal means 20 to a source of pressurized water, preferably in a manner which allows for easy and quick connection and disconnection. The pressurized water source is preferably a conduit from the discharge side of the pool pump. In pools having a built-in automatic pool cleaning apparatus, the invention may be directly connected to the water conduit used for operation of the pool cleaning apparatus. Thus when the pump is operating, pressurized water is directed into the chamber 26 or manifold 48 and emitted as a plurality of pressurized fluid streams from apertures 21 or nozzles 22 and through opening 46.

In the most preferred embodiment, an air entrainment means 50 is provided which supplies air into the pressurized water such that the pressurized stream emitted from the fluid dispersal means 20 is a combination of air and water. While air entrainment means 50 may comprise a pump which draws air from the atmosphere and delivers it into the fluid dispersal means 20, the preferred mechanism is to provide a venturi-type mixing junction member 51 as part of the water inlet 24, such that the flow of the water through the mixing junction member 51 causes air to be drawn through a tube 52 which is open to the atmosphere. With this structure no extraneous pump is required. The tube 52 is preferably attached to one of the arm supports 45 of the chair 41 to insure that the tube 52 remains above the water during use. A control valve 53 may be incorporated for adjusting the flow volume of the air into the tube 52, which allows the user to increase or decrease the force of the pressurized fluid streams striking the user's back. Alternatively, a water control valve may be incorporated into or connected in-stream with the water inlet 24 to allow the user to adjust the flow of water into the chamber 26 or manifold 48.

The fluid dispersal means 20 is preferably adjustable in the longitudinal direction relative to the opening 46 in the chair 41, which allows the user to vary the position of the pressurized fluid streams so as to strike different areas of the user's body. Different structures can be utilized to accomplish this. As illustrated in FIGS. 3 and 4, a housing 61 made of plastic or similar material and having a longitudinal slot 62 may be attached to extend from the rear of the chair 41 to enclose the chamber 26, the slot 62 allowing the chamber 26 to be moved longitudinally. As shown in FIG. 5, the chamber 26 may be mounted onto one or more rail members 63 extending from the back of the chair 41, with the major portion of the rail member 63 extending generally longitudinally and relatively parallel to the back supporting region 42. The rail or rails 63 may extend through the chamber 26 or may be connected by externally mounted fasteners. As shown in FIG. 6, the back support region 42 of the chair 41 may be formed from multiple layers of buoyant material, with lateral guide slots 64 extending longitudinally along each side of opening 46 internally within the back support region 42 to receive lateral runners 65 connected to the main chamber 26. Reinforcing members of relatively hard plastic or the like may be inserted within the lateral guide slots. A longitudinal slot 62 is positioned beneath the opening 46 to receive water inlet 24. In all of these embodiments, the chamber 26 can be moved longitudinally such that the pressurized streams can be directed toward the upper, lower or any intermediary region of the opening 46.

The fluid dispersal means 20 may also be adjustable in relation to the separation distance from the back supporting region 42. One mechanism for accomplishing this is shown in FIG. 5, where separation adjustment means 70 comprises a telescoping arrangement with an inner member 71 and outer sleeve member 72 which are coaxially extendable.

It is understood that substitutions and equivalents to certain elements set forth above may be obvious to those skilled in the art, and the true scope and definition of the invention therefore is to be as set forth in the following claims.

We claim:

1. A floating water massage device for supporting a person's body within a swimming pool and directing pressurized fluid streams against the person's body, comprising body support means to support the body of the person at or near the surface of the water in a generally reclined position such that the head of the person is maintained above the surface of the water, said body support means comprising a floating pad member having a generally planar upper leg supporting region joined to a generally planar back supporting region in a V-shaped manner and a relatively large opening positioned in said back supporting region;

fluid dispersal means for directing plural pressurized streams of fluid against the body of the person, said fluid dispersal means attached to said body support means below said opening such that said fluid dispersal means is separated a distance from the body of the person and from said back supporting region of said floating pad member, wherein said plural pressurized fluid streams are directed through said opening and are unobstructed by said body support means.

2. The device of claim 1, wherein the location of said fluid dispersal means is adjustable relative to said opening and said body support means.

3. The device of claim 1, wherein said fluid dispersal means comprises a water inlet connected to a conduit providing a source of pressurized water, and a chamber receiving water from said water inlet, said chamber having a plurality of apertures which emit said pressurized fluid streams.

4. The device of claim 3, further comprising air entrainment means for supplying air into said pressurized fluid streams, wherein said air entrainment means comprises a tube open to the atmosphere and joined to said water inlet, and a venturi-type mixing junction member connected to said water inlet and said tube which mixes the air into the water.

5. The device of claim 4, further comprising a control valve to control the amount of air passing through said tube.

6. The device of claim 3, wherein said fluid dispersal means is disposed within a housing mounted onto said body support means.

7. The device of claim 3, wherein said fluid dispersal means is disposed on one of more rails mounted onto said body support means.

8. The device of claim 3, wherein said fluid dispersal means is disposed within the interior of said body support means.

9. The device of claim 3, further comprising nozzles positioned within said apertures.

10. The device of claim 3, wherein the location of said fluid dispersal means is adjustable relative to said opening and said body support means.

11. The device of claim 1, wherein said fluid dispersal means comprises a water inlet connected to a conduit providing a source of pressurized water, and a manifold receiving water from said water inlet, said manifold having a plurality of apertures which emit said pressurized fluid streams.

12. The device of claim 11, wherein the location of said fluid dispersal means is adjustable relative to said opening and said body support means.

13. The device of claim 1, wherein said body support means is composed of a polymer foam material.

* * * * *